US011248439B2

(12) United States Patent
Tedjani

(10) Patent No.: US 11,248,439 B2
(45) Date of Patent: Feb. 15, 2022

(54) PLUGS AND RELATED METHODS OF PERFORMING COMPLETION OPERATIONS IN OIL AND GAS APPLICATIONS

(71) Applicant: Saudi Arabian Oil Company, Dhahran (SA)

(72) Inventor: Hamza Fethiza Tedjani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 6 days.

(21) Appl. No.: 16/863,097

(22) Filed: Apr. 30, 2020

(65) Prior Publication Data

US 2021/0340839 A1 Nov. 4, 2021

(51) Int. Cl.

| | |
|---|---|
| ***E21B 33/16*** | (2006.01) |
| ***E21B 49/00*** | (2006.01) |
| ***E21B 34/06*** | (2006.01) |
| *E21B 23/04* | (2006.01) |

(52) U.S. Cl.

CPC ..... *E21B 33/16* (2013.01); *E21B 34/063* (2013.01); *E21B 49/008* (2013.01); *E21B 23/0413* (2020.05)

(58) Field of Classification Search

CPC .. E21B 23/04; E21B 23/0413; E21B 23/0418; E21B 33/1204; E21B 33/16; E21B 34/063

See application file for complete search history.

(56) References Cited

U.S. PATENT DOCUMENTS

| | | | |
|---|---|---|---|
| 4,541,490 | A | 9/1985 | Bigbie et al. |
| 5,076,356 | A | 12/1991 | Reimert |
| 6,082,451 | A | 7/2000 | Giroux et al. |
| 6,491,108 | B1 | 12/2002 | Slup et al. |
| 7,281,582 | B2 | 10/2007 | Robichaux et al. |
| RE41,508 | E | 8/2010 | Treece |
| 7,828,060 | B2 | 11/2010 | Churchill |
| 9,593,545 | B2 | 3/2017 | Churchill |
| 9,797,240 | B2 | 10/2017 | Tunget |
| 9,835,009 | B2 | 12/2017 | Hess et al. |
| 9,951,600 | B2 | 4/2018 | Hannegan et al. |
| 10,487,587 | B2 | 11/2019 | Cummins |
| 2005/0103493 | A1 | 5/2005 | Stevens et al. |

(Continued)

FOREIGN PATENT DOCUMENTS

| | | |
|---|---|---|
| WO | 2016101374 | 6/2016 |

OTHER PUBLICATIONS

Bumbaugh, "Cleveland Formation—Recent Results and Lessons Learned During Horizontal Re-development of a Mature Field," SPE-142790-MS, Presented at SPE Middle East Unconventional Gas Conference and Exhibition, Muscat, Oman, Jan. 31-Feb. 2, 2011; Society of Petroleum Engineers, 2011, 9 pages.

(Continued)

*Primary Examiner* — Tara Schimpf

(74) *Attorney, Agent, or Firm* — Fish & Richardson P.C.

(57) ABSTRACT

A method of performing a completion operation at a wellbore includes flowing a plug downhole within fluid through a pipe disposed within the wellbore, landing the plug on a platform carried on the pipe to close the pipe to fluid flow, flowing fluid downhole through the pipe against the plug positioned on the platform, and rupturing a disk of the plug with a pressure of the fluid to open the pipe to fluid flow through a channel of the plug.

17 Claims, 6 Drawing Sheets

(56) References Cited

U.S. PATENT DOCUMENTS

| | | | | |
|---|---|---|---|---|
| 2006/0102348 | A1 | 5/2006 | Churchill | |
| 2015/0285024 | A1 | 10/2015 | Sanchez et al. | |
| 2018/0112488 | A1 | 4/2018 | Budde et al. | |
| 2018/0313206 | A1 | 11/2018 | Dirksen et al. | |
| 2019/0257193 | A1* | 8/2019 | Telfer | E21B 23/04 |
| 2020/0318453 | A1* | 10/2020 | Francis | E21B 33/16 |
| 2021/0071500 | A1* | 3/2021 | Hoffman | E21B 34/063 |
| 2021/0140275 | A1* | 5/2021 | Nanney | E21B 33/16 |

OTHER PUBLICATIONS

Bybee, "Coiled-Tubing Underbalanced Drilling in the Lisbume Field, Alaska," SPE-0608-0079-JPT, Journal of Petroleum Technology, Jun. 2008, 60(6):79-82.

Guizada et al., "Application of Underbalanced Coiled Tubing Drilling Technology to Enhance Gas Production in Deep Carbonate Reservoirs," SPE-192786-MS, Presented at Abu Dhabi International Petroleum Exhibition & Conference, Abu Dhabi, UAE, Nov. 12-15, 2018; Society of Petroleum Engineers, 2018, 8 pages.

Johnson et al., "Coiled-Tubing Underbalanced Drilling Applications in the Lisburne Field, Alaska," IADC/SPE 108337, Presented at 2007 IADC.SPE Managed Pressure Drilling and Underbalanced Operations Conference and Exhibition, Galveston, Texas, Mar. 28-29, 2007; IADC/SPE, 2007, 11 pages.

Leising et al., "Underbalanced Drilling With Coiled Tubing and Well Productivity," SPE-28870-MS, Presented at the SPE European Petroleum Conference, London, UK, Oct. 25-27, 1994; Society of Petroleum Engineers, 1994, 16 pages.

Omair et al., "Enhanced Sustained Production from Successful Underbalanced Coiled Tubing Drilling in Saudi Arabian Deep Tight Gas Sandstone and Carbonate Formations," SPE-142363-MS-P, Presented at the SPE Middle East Oil and Gas Show and Conference, Manama, Bahrain, Sep. 25-28, 2011; Society of Petroleum Engineers, 2011, 9 pages.

Pruitt et al., "Underbalanced coiled tubing drilling update on a successful campaign," SPE-92513-MS, Presented at SPE/IADDC Drilling Conference, Amsterdam, The Netherlands, Feb. 23-25, 2005; SPE/IADC Drilling Conference, 2005, 8 pages.

Silva et al., "A Process Delivery Template for an Underbalanced Coiled Tubing Drilling Project from Concept to Execution," SPE-107244-MS, Presented at 2007 SPE/ICoTA Coiled Tubing and Well Intervention Conference and Exhibition, The Woodlands, Texas, Mar. 20-21, 2007; Society of Petroleum Engineers, 2007, 10 pages.

Kavanagh et al., "Underbalanced Coiled Tubing Drilling Practices in a Deep, Low-Pressure Gas Reservoir," IPTC-10308-MS, Presented at the International Petroleum Technology Conference, Doha, Qatar, Nov. 21-23, 2005; IPTC, 2005, 9 pages.

PCT International Search Report and Written Opinion in International Appln. No. PCT/US2021/029933, dated Aug. 19, 2021, 13 pages.

* cited by examiner

PLUGS AND RELATED METHODS OF PERFORMING COMPLETION OPERATIONS IN OIL AND GAS APPLICATIONS

TECHNICAL FIELD

This disclosure relates to plugs and related methods of performing a completion operation at a wellbore using the plugs.

BACKGROUND

While performing completion activities at wells (for example, gas exploration wells) designated for various future fracking jobs, completion tubing must be examined for leaks and internal obstructions that could compromise such future jobs. The examinations may be performed conventionally by controlling a surface pressure at the completion tubing and deploying a bridge plug to the completion tubing on a slick line. This conventional practice is limited by a capability of the slick line, which may be affected by a mud weight, a slick line maximum over pull load, and a well trajectory. Such factors can make it impossible to perform a single drifting operation, a single wiping operation, and a single pressure testing operation at one time for the entire completion tubing, thereby causing a need to perform multiple drifting operations, multiple wiping operations, and multiple pressure testing operations while running the completion tubing along a well.

SUMMARY

This disclosure relates to a plug that is designed for carrying out multiple completion operations at a wellbore and methods of using the plug to carrying out such completion operations in parallel and in series as part of a single operational effort. The multiple completion operations may include drifting, wiping, and pressure testing of a pipe that is run into the wellbore.

In one aspect, a method of performing a completion operation at a wellbore includes A method of performing a completion operation at a wellbore includes flowing a plug downhole within fluid through a pipe disposed within the wellbore, landing the plug on a platform carried on the pipe to close the pipe to fluid flow, flowing fluid downhole through the pipe against the plug positioned on the platform, and rupturing a disk of the plug with a pressure of the fluid to open the pipe to fluid flow through a channel of the plug.

Embodiments may provide one or more of the following features.

In some embodiments, the method further includes circulating fluid through the pipe as the plug flows downhole through the pipe.

In some embodiments, flowing the plug downhole includes drifting the pipe.

In some embodiments, flowing the plug downhole includes wiping the pipe.

In some embodiments, the method further includes drifting and wiping the pipe simultaneously.

In some embodiments, flowing fluid downhole through the pipe against the plug includes pressure testing the pipe.

In some embodiments, the method further includes pressure testing the pipe after drifting and wiping the pipe.

In some embodiments, the platform includes a float collar.

In some embodiments, flowing fluid downhole through the pipe against the plug includes increasing a fluid pressure within the pipe.

In some embodiments, the method further includes increasing the fluid pressure above a burst pressure of the disk to rupture the disk.

In some embodiments, the method further includes reducing a fluid pressure within the pipe upon rupturing the disk of the pipe.

In some embodiments, the method further includes circulating fluid through the pipe and the plug following rupture of the disk.

In some embodiments, the method further includes determining a volume of fluid displaced by the plug within the pipe.

In some embodiments, the method further includes determining a presence of damage to the pipe based on the volume of fluid displaced by the plug.

In some embodiments, the method further includes retrieving the pipe from the wellbore, repairing the pipe, and redeploying the pipe to the wellbore.

In some embodiments, the method further includes locating the pipe at a first axial position along the wellbore prior to flowing the plug downhole through the pipe.

In some embodiments, the method further includes locating the pipe at a second axial position along the wellbore after rupturing the disk of the plug, the second axial position being downhole relative to the first axial position.

In some embodiments, the plug is a first plug, the disk is a first disk, the channel is a first channel, and the fluid pressure is a first fluid pressure, and the method further includes flowing a second plug downhole within fluid through the pipe, landing the second plug on the first plug, flowing fluid downhole through the pipe against the second plug positioned on the first plug, and rupturing a second disk of the second plug with a second pressure of the fluid to open the pipe to fluid flow through a second channel of the second plug and through the first channel of the first plug.

In another aspect, a plug includes a cylindrical body defining an axial channel therethrough, a recessed profile disposed at a first end, and a protruding profile disposed at a second end and formed complimentary to the recessed profile. The plug further includes a rupture disk extending across the axial channel of the cylindrical body.

The details of one or more embodiments are set forth in the accompanying drawings and description. Other features, aspects, and advantages of the embodiments will become apparent from the description, drawings, and claims.

DETAILED DESCRIPTION

Figure 1:
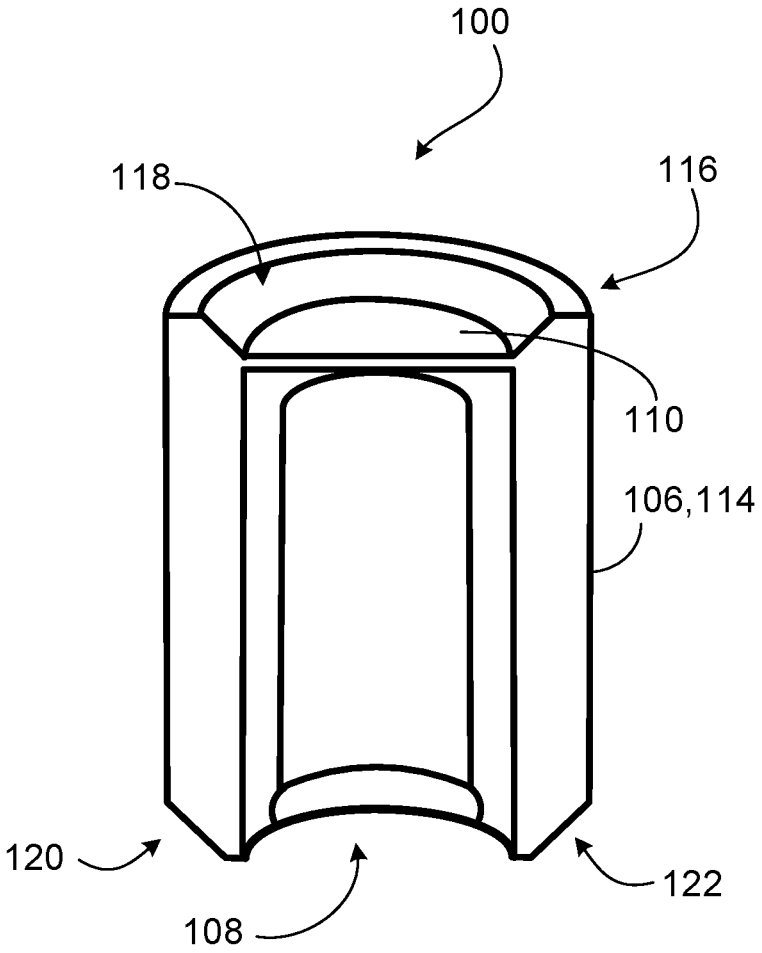
FIG. 1 is a perspective cross-sectional view of a plug designed for performing a completion operation at a wellbore.
Figure 2:
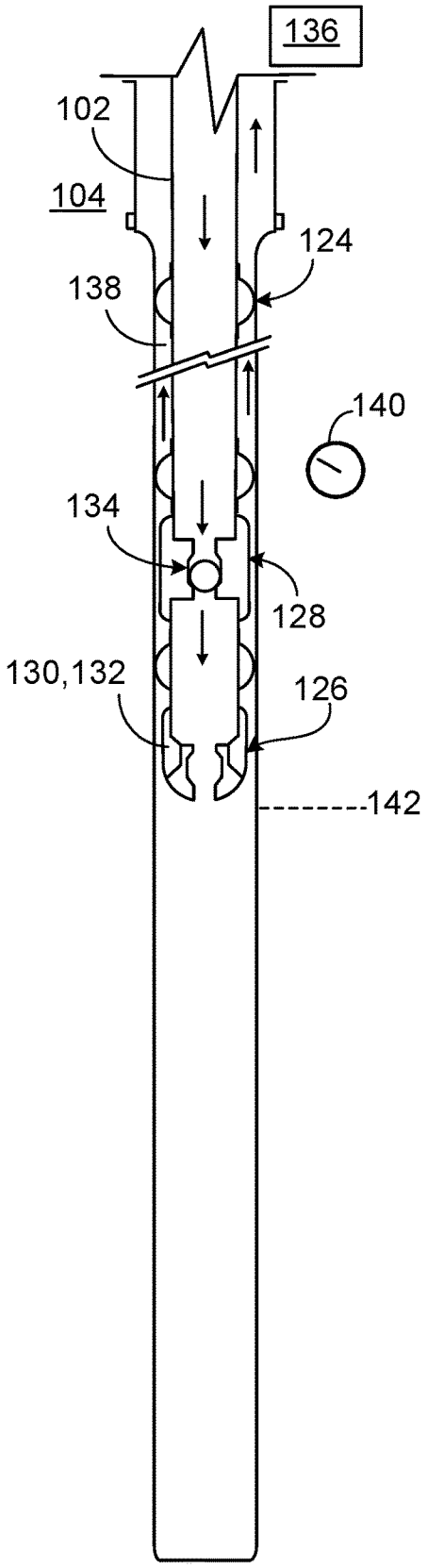
FIGS. 2-9 sequentially illustrate a method of performing a completion operation that includes multiple sub-operations at a wellbore using one or more of the plugs of FIG. 1.

Referring to FIGS. 1 and 2, a plug 100 is designed for carrying out multiple completion operations within a pipe 102 (for example, a tubular casing joint) at a wellbore 104. The plug 100 includes a cylindrical body 106 defining a channel 108 and a rupture disk 110 that extends across the body 106. The plug 100 is sized to perform certain operations within the pipe 102 as the plug 100 passes through the pipe 102 and reaches a resting platform (for example, a float collar or another plug) within the pipe 102. The plug 100 is formed to be deployed within pipes at wellbores of various configurations, including vertical wellbores, horizontal wellbores, and deviated wellbores.

The plug 100 can be deployed within the pipe 102 to perform a drifting operation in which the plug 100 is flowed within a drilling mud (for example, pumped) through a channel 112 of the pipe 102 to determine whether or not the pipe 102 exhibits any damage that obstructs the channel 112. A drift diameter is a minimum internal diameter of a pipe and is provided as a guaranteed specification that generally allows determination of a size of equipment that can be run through the pipe. Significant resistance to travel of the plug 100 through the pipe 102 may indicate damage to a wall 114 of the pipe 102 that results in a reduced diameter of the pipe 102 along the section of resistance. Such damage may cause failures to occur during subsequent operations, such as cementing and fracking. Once the plug 100 has reached a resting position within the pipe 102, a drifted interval can be calculated as a length (for example, a depth at which damage is present) resulting from dividing a volume of fluid displaced within the pipe 102 by the plug 102, by a total capacity of the pipe 102.

Furthermore, the plug 100 can simultaneously perform a wiping operation within the pipe 102 as the plug 100 flows through the channel 112 of the pipe 102 during the drifting operation. During the wiping operation, the plug 100 removes (for example, scrapes or pushes away) any mud (for example, films or clumps) or other particulates that are deposited or otherwise accumulated along an inner surface of the wall 114 of the pipe 102. In some examples, wiping away such deposits helps to prevent any potential occurrence of wet shoe (for example, an accumulation of unset cement along a section of the pipe 102). During a cement job, only one or two wiper plugs are typically used. This few number of wiper plugs removes only part of any mud film deposited on the internal surface of a pipe. Deploying additional plugs while running the pipe 102 will help further remove mud film, especially since mid-process deployment of plugs 100 allows less time for the mud to deposit, as compared to conventional techniques in which wiping is only performed once a pipe is completely run within a wellbore.

The plug 100 has a constant outer diameter that falls within a range defined by the drift diameter of the pipe 102 at a lower bound and an actual internal diameter of the pipe 102 at an upper bound. In some embodiments, the outer diameter of the pipe 102 falls in a range of about 0.11 meters (m) to about 0.47 m, and an inner diameter of the pipe 102 falls in a range of about 0.10 m to about 0.45 m. In some embodiments, the plug 102 has a total length that falls in a range of about 0.3 m to about 0.6 m. In some embodiments, the body 106 of the plug 100 is a rigid structure that is made out of metal. In some embodiments, the body 106 of the plug 100 is a flexible structure that is made out of rubber. The body 106 may be provided as rigid or flexible, depending on a size of a pipe in which the plug 100 is to be deployed, a depth to which the plug 100 is to be deployed, properties of the drilling fluid within the pipe, and pressure test parameters.

The rupture disk 110 of the plug 100 is recessed from an uphole end 116 of the body 102 and closes the channel 112 to flow at the uphole end 116. The rupture disk 100 is rated at a defined burst pressure (for example, a maximum differential pressure), above which the rupture disk 110 will burst to allow flow through the channel 112. For example, the plug 100 can be deployed within the pipe 102 to conduct a pressure test in which fluid is pumped into the pipe 102 atop or otherwise against the plug 102. Once a pressure of the fluid exceeds the burst pressure, the pressure will cause the rupture disk 110 to burst and therefore allow the fluid to flow through the channel 108 of the plug 102. The burst pressure of the rupture disk 110 is generally higher than a testing pressure of the pressure test, but less than a burst pressure of the pipe 102, with a factor of safety applied. In some embodiments, the rupture disk 110 has a burst pressure that falls within a range of about $3.45\times10^6$ Pa to about $3.45\times10^7$ Pa. In some embodiments, the rupture disk 110 has a thickness that falls within a range of about 2.5 millimeters (mm) to about 25.4 mm. The rupture disk 110 is made of one or more materials that can withstand pressures up to the defined burst pressure, such as metal or carbon graphite.

The body 106 of the plug 102 defines an inward beveled edge 118 that provides a recessed seat adjacent the rupture disk 110 at the uphole end 116 of the plug 102 and an outward beveled edge 120 that provides a mating profile (for example, an abutment surface) at a downhole end 122 of the plug 102. The outward edge 120 is formed complementary to the inward edge 118 to allow one plug 102 to seat within another plug 102 in a stacked arrangement, as shown in FIGS. 6-9.

FIGS. 2-9 sequentially illustrate a method of performing a completion operation at a wellbore 104 using multiple plugs 100. In some examples, the completion operation includes multiple sub-operations of drifting, wiping, and pressure testing a pipe 102 installed at the wellbore 104. Referring to FIG. 2, the pipe 102 is made of steel and has been run in the wellbore 104 to a selected first depth 142 (for example, a selected first axial position). In some examples, the depth is selected as a determined fraction of a length of the pipe 102. In some examples, the depth is selected as an absolute bottom hole depth within the wellbore 104. The pipe 102 is installed with centralizers 124 that center the pipe 102 within the wellbore 104, a float shoe 126 that reinforces a lower end of the pipe 102 and guides the pipe 102 away from ledges during deployment, and a float collar 128 that provides a landing platform (for example, a seat) for a plug 100 or another type of plug. The float shoe 126 includes a body 130 and an internal spring-loaded backpressure valve 132 that prevents a reverse flow of cement back up into the pipe 102 following a cementing operation. In addition to providing a landing platform for a plug, the float collar 128 also provides a backup check valve 134 that prevents reverse flow through the pipe 102 in case the float shoe 126 fails to provide a seal.

Fluid (for example, drilling mud) is pumped downhole into the channel 112 of the pipe 102 from a surface pumping device 136 that is fluidly connected to the pipe 102. The fluid flows through the float collar 128 and the float shoe 126 and returns uphole back to the surface through an annular region 138 (for example, an annulus) defined between the pipe 102 and the wellbore 104. With the channel 112 open to flow, a surface pressure gauge 140 that is fluidly connected to the pipe 102 reads a null or relatively low value as the fluid is circulated at the wellbore 104 in this manner.

Figure 3:
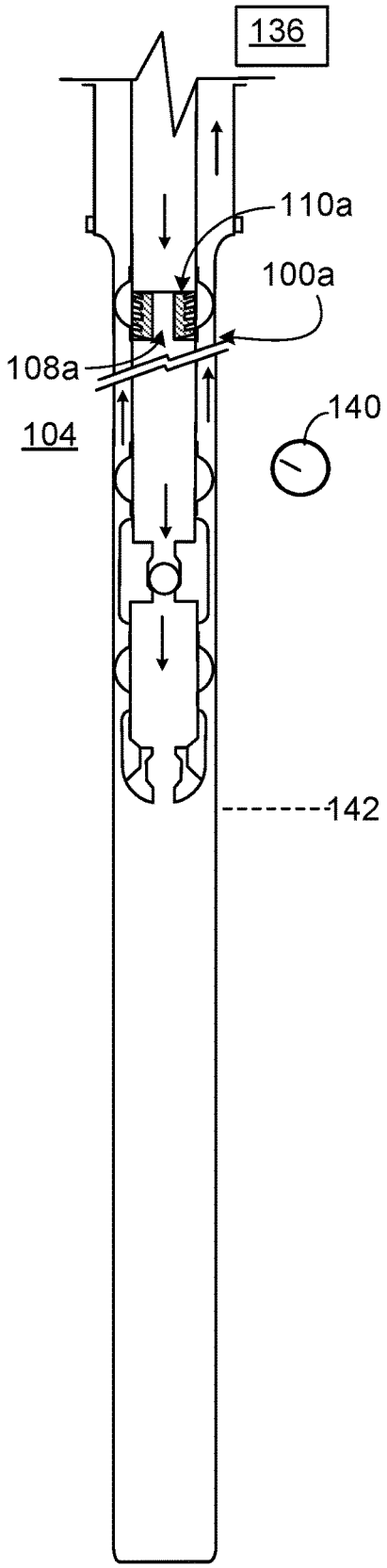

Referring to FIG. 3, a first plug **100*a* is dropped inside of the channel 112 of the pipe 102, and fluid is pumped downhole into the channel 112 behind the plug 100*a*. The pressure gauge 140 still reads a relatively low value as the first plug 100*a* is pumped downhole. The reading at the pressure gauge 140 may gradually increase as the fluid flow rate increases to cause the fluid pressure to approach the burst pressure of the rupture disk 110. The plug 100*a*** simultaneously performs drifting and wiping operations along the pipe 102 as the plug 100*a* travels through the pipe 102.

Figure 4:
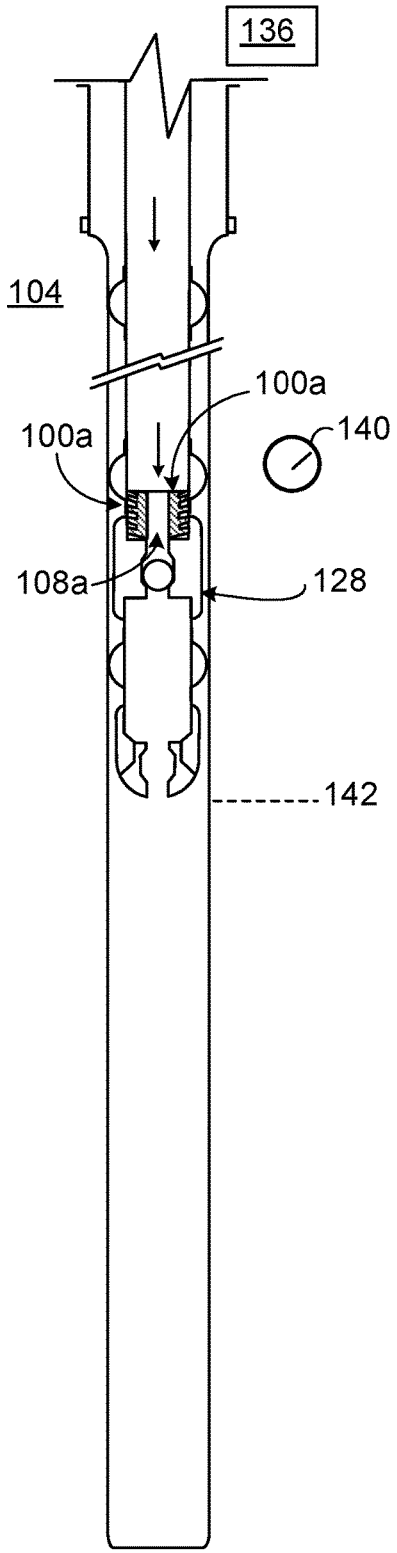

Referring to FIG. 4, pumping continues until the first plug 100*a* abuts the float collar 128, as confirmed by an increased reading at the pressure gauge 140. With the first plug 100*a* landed on the float collar 128, a first drift interval can be calculated. If the total capacity of the pipe 102 is pumped before the increase in pressure shown at the pressure gauge 140, then the total length of the pipe 102 has been drifted, and the plug 100*a* has landed on the float collar 128. Otherwise, if the pipe 102 is damaged, then a depth of the damage can be calculated by dividing the displaced volume by the pipe capacity. If any damage to the pipe 102 is identified, then the pipe 102 will be pulled out until the damaged location is accessible, and the damaged segment of the pipe 102 will be replaced.

Landing of the plug 100*a* closes the channel 112 of the pipe 102 to flow such that a pressure test can be performed on the pipe 102 to test a mechanical integrity of the portion of the pipe 102 that is deployed between the surface and the depth of the plug 100*a*. Accordingly, the pumping device 136 continues to pump the fluid downhole into the channel 112 until a desired test pressure is achieved within the fluid. The test pressure is maintained for a desired period of time (for example, a predetermined test period), such as for about 15 minutes (m) to about 30 m.

Figure 5:
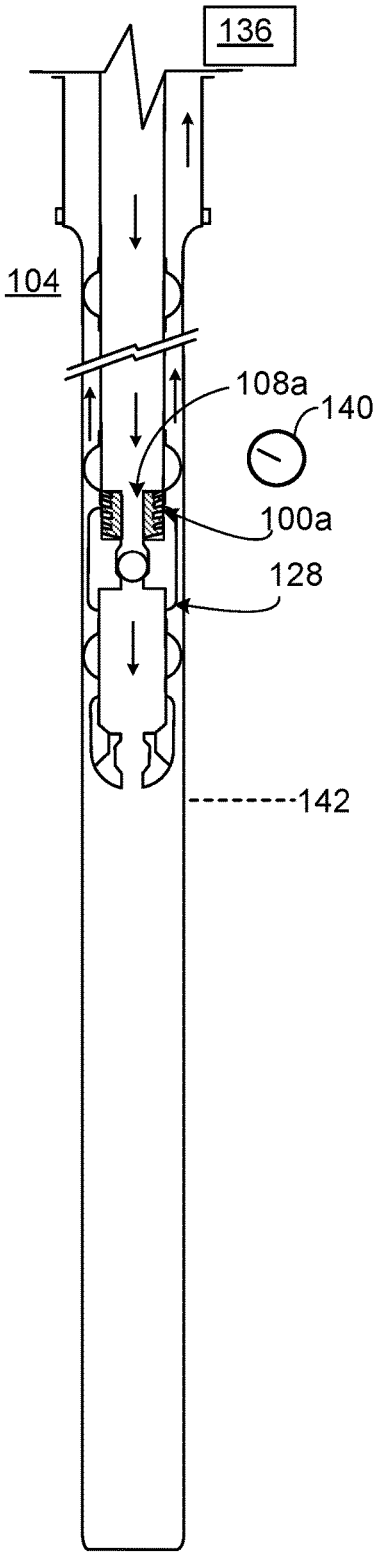

Referring to FIG. 5, the pumping device 136 continues still to pump fluid downhole into the channel 112 until the burst pressure of a rupture disk 110*a* of the plug 100*a* is exceeded, therefore causing the rupture disk 110*a* to break apart. The burst pressure of the rupture disk 110 is generally higher than a testing pressure of the pressure test, but less than a burst pressure of the pipe 102, with a factor of safety applied. Destruction of the rupture disk 110*a* reopens the channel 112 of the pipe 102 to fluid flow to allow normal operations to resume at the wellbore 104. Meanwhile, the reading of the pressure gauge 140 accordingly returns to a null or relatively low value. Normal operations that may continue at the wellbore 104 include further running of the pipe 102 within the wellbore 104, cementing operations, and further drilling of the plug 100*a* after the pipe 102 is cemented.

Figure 6:
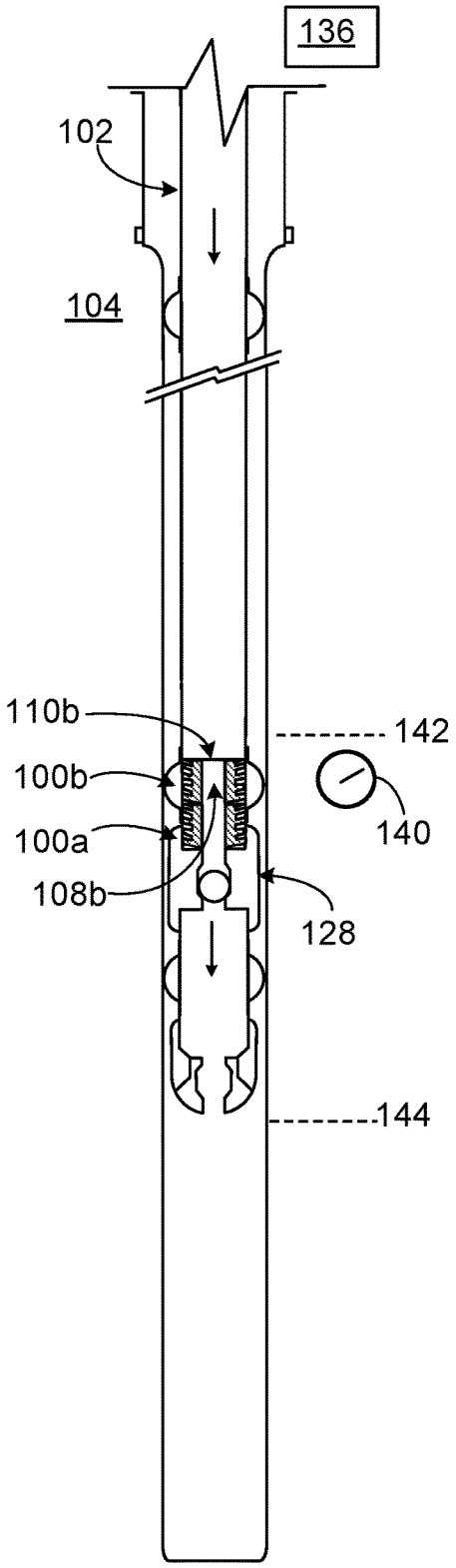

Referring to FIG. 6, the pipe 102, equipped with the first plug 100*a*, may be run to a second selected depth 144 (for example, a second selected axial position) within the wellbore 104 so that the process described above with respect to FIGS. 3-5 can be repeated at the depth 144. For example, a second plug 100*b* is dropped inside of the channel 112 of the pipe 102, and fluid is pumped downhole into the channel 112 behind the plug 100*b*. The plug 100*b* simultaneously performs drifting and wiping operations along the pipe 102 as the plug 100*b* travels through the pipe 102. Pumping continues until the second plug 100*a* abuts the first plug 100*a*, as confirmed by an increased reading at the pressure gauge 140. With the second plug 100*b* landed on the first plug 100*a*, a second interval known as a shoe track can be calculated, but is not of interest in relation to the pressure test, as the interval will be covered with cement during the cement job. If any damage to the pipe 102 is identified, then the pipe 102 will be pulled out until the damaged location is accessible, and the damaged segment of the pipe 102 will be replaced.

Landing of the plug 100*b* closes the channel 112 of the pipe 102 to flow such that a pressure test can be performed on the pipe 102 to test a mechanical integrity of the pipe 102 along a length of the pipe 102 now disposed between the surface and the first depth 142. Accordingly, the pumping device 136 continues to pump the fluid downhole into the channel 112 until a desired test pressure is achieved within the fluid, and the test pressure is maintained for the predetermined test period.

Figure 7:
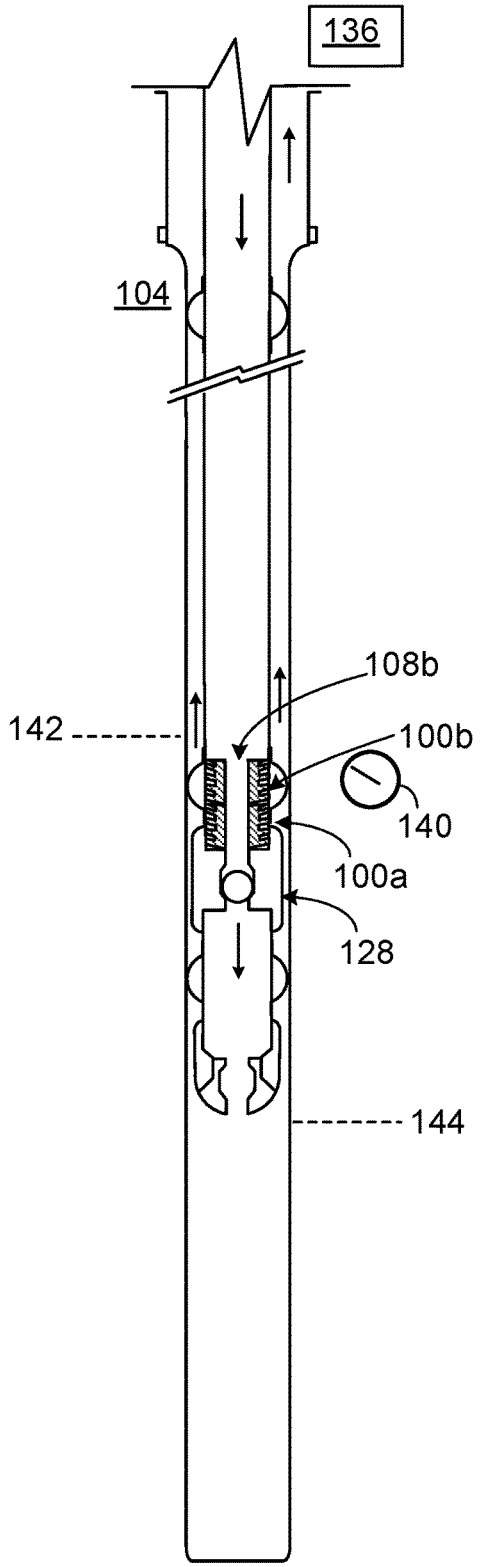

Referring to FIG. 7, the pumping device 136 continues still to pump fluid downhole into the channel 112 until the burst pressure of a rupture disk 110*b* of the plug 100*b* is exceeded, therefore causing the rupture disk 110*b* to break apart. Destruction of the rupture disk 110*b* reopens the channel 112 of the pipe 102 to flow to allow continued normal operations to resume at the wellbore 104. Meanwhile, the reading of the pressure gauge 140 accordingly returns to a null or relatively low value.

Figure 8:
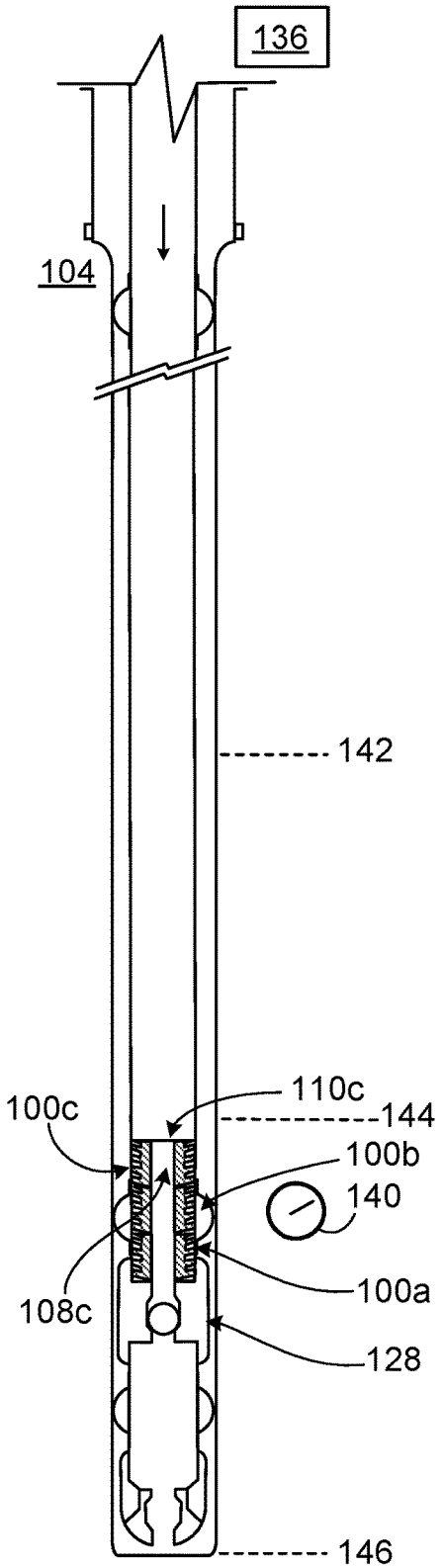

Referring to FIG. 8, the pipe 102, equipped with the first and second plugs 100*a*, 100*b*, may be run to a third selected depth 146 within the wellbore 104 so that the process described above with respect to FIGS. 3-5 and FIGS. 6-7 can be repeated at the depth 146. For example, a third plug 100*c* is dropped inside of the channel 112 of the pipe 102, and fluid is pumped downhole into the channel 112 behind the plug 100*c*. The plug 100*c* simultaneously performs drifting and wiping operations along the pipe 102 as the plug 100*c* travels through the pipe 102. Pumping continues until the third plug 100*b* abuts the second plug 100*b*, as confirmed by an increased reading at the pressure gauge 140. With the third plug 100*c* landed on the second plug 100*b*, a third drift interval can be calculated. Landing of the plug 100*c* closes the channel 112 of the pipe 102 to flow such that a pressure test can be performed on the pipe 102 to test a mechanical integrity of the pipe 102 now disposed between the surface and the first depth 142. Accordingly, the pumping device 136 continues to pump the fluid downhole into the channel 112 until a desired test pressure is achieved within the fluid, and the test pressure is maintained for the predetermined test period.

Figure 9:
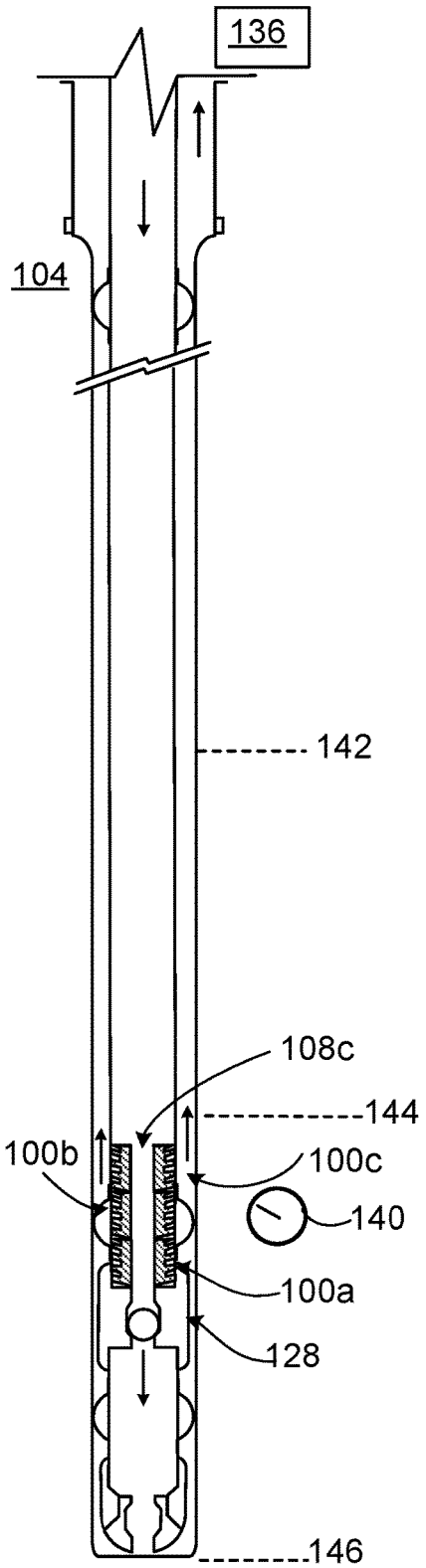

Referring to FIG. 9, the pumping device 136 continues still to pump fluid downhole into the channel 112 until the burst pressure of the rupture disk 110*c* of the plug 100*c* is exceeded, therefore causing the rupture disk 110*c* to break apart. Destruction of the rupture disk 110*c* reopens the channel 112 of the pipe 102 to flow to allow normal operations to resume at the wellbore 104. Meanwhile, the reading of the pressure gauge 140 accordingly returns to a null or relatively low value. Additional plugs 100 may be deployed to the pipe 102 after running the pipe 102 to further depths along the wellbore 104 for performing additional drifting, wiping, and pressure testing operations as described above with respect to FIGS. 2-9.

According to the methods described above with respect to FIGS. 2-9, deployment of one or more plugs 100 to a wellbore can advantageously allow performance of drifting, wiping, and pressure testing sub-operations in one completion effort. The streamlined completion effort, including simultaneous drifting and wiping sub-operations, followed by a subsequent pressure testing sub-operation, can result in early identification of damage to the pipe 102 before the pipe 102 is run to a final, ultimate depth or axial position within the wellbore. If any damage is identified, a deployed portion of the pipe 102 can be retrieved, repaired or replaced, redeployed, and retested before the pipe 102 is run to any further depth along the wellbore. In contrast, conventional methods identify damage to such a pipe only once the pipe has reached its final depth within a wellbore, requiring a costly and time-consuming retrieval of the fully deployed pipe. Accordingly, deployment and utilization of one or more plugs 100 can avoid extensive nipple up and nipple down tasks for a slick line lubricator that may otherwise be required for retrieving such a pipe that is fully deployed within a wellbore and subsequently redeploying the pipe to the wellbore.

Figure 10:
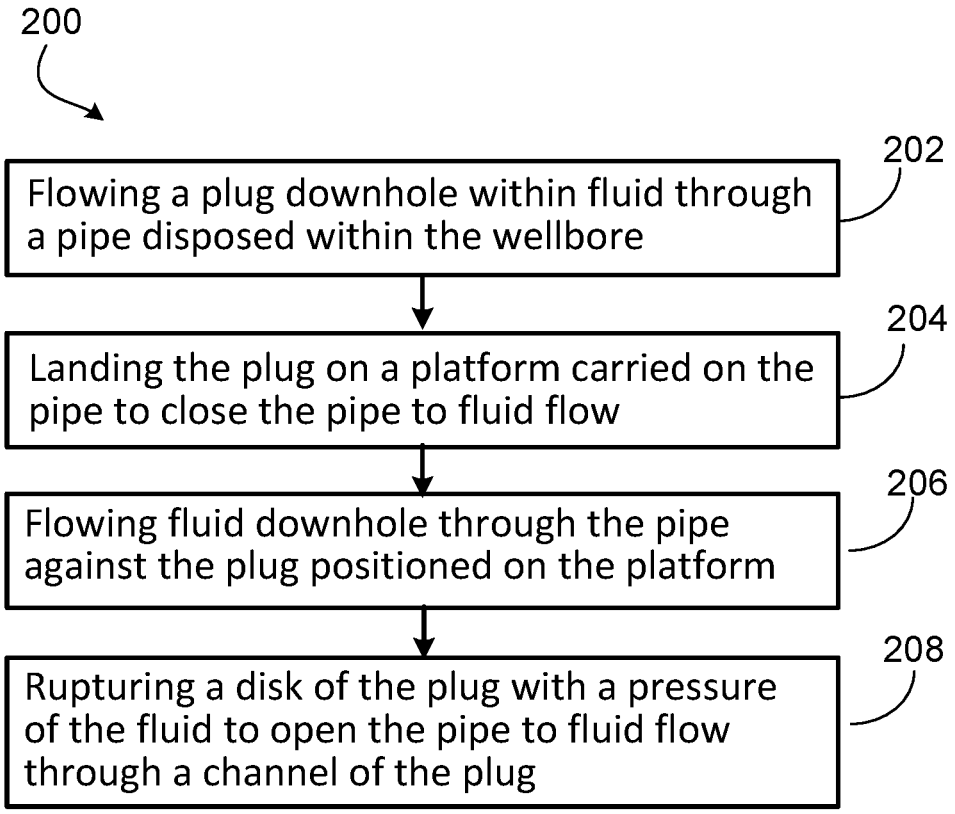
FIG. 10 is a flow chart illustrating an example method of performing a completion operation at a wellbore using one or more of the plugs of FIG. 1.

FIG. 10 is a flow chart illustrating an example method 200 of performing a completion operation at a wellbore (for example, the wellbore 104). In some embodiments, the method 200 includes a step 202 of flowing a plug (for example, the plug 100) downhole within fluid through a pipe (for example, the pipe 102) disposed within the wellbore. In some embodiments, the method 200 further includes a step 204 of landing the plug on a platform (for example, the float collar 128 or another plug 100) carried on the pipe to close the pipe to fluid flow. In some embodiments, the method 200 further includes a step 206 of flowing fluid downhole through the pipe against the plug positioned on the platform. In some embodiments, the method 200 further includes a step 208 of rupturing a disk (for example, the rupture disk 110) of the plug with a pressure of the fluid to open the pipe to fluid flow through a channel (for example, the channel 108) of the plug.

While the plug 100 has been described and illustrated with respect to certain dimensions, sizes, shapes, arrangements, materials, and methods 200, in some embodiments, a plug that is otherwise substantially similar in construction and function to the plug 100 may include one or more different dimensions, sizes, shapes, arrangements, and materials or may be utilized according to different methods.

Accordingly, other embodiments are also within the scope of the following claims.

What is claimed is:

1. A method of performing a completion operation at a wellbore, the method comprising:

flowing a plug downhole within fluid through a pipe disposed within the wellbore;

landing the plug on a platform carried on the pipe to close the pipe to fluid flow;

determining a volume of fluid displaced by the plug within the pipe;

determining a presence of damage to the pipe based on the volume of fluid displaced by the plug;

flowing fluid downhole through the pipe against the plug positioned on the platform; and rupturing a disk of the plug with a pressure of the fluid to open the pipe to fluid flow through a channel of the plug.

2. The method of claim 1, further comprising circulating fluid through the pipe as the plug flows downhole through the pipe.

3. The method of claim 1, wherein flowing the plug downhole comprises drifting the pipe.

4. The method of claim 3, wherein flowing the plug downhole comprises wiping the pipe.

5. The method of claim 4, further comprising drifting and wiping the pipe simultaneously.

6. The method of claim 4, wherein flowing fluid downhole through the pipe against the plug comprises pressure testing the pipe.

7. The method of claim 6, further comprising pressure testing the pipe after drifting and wiping the pipe.

8. The method of claim 1, wherein the platform comprises a float collar.

9. The method of claim 1, wherein flowing fluid downhole through the pipe against the plug comprises increasing a fluid pressure within the pipe.

10. The method of claim 9, further comprising increasing the fluid pressure above a burst pressure of the disk to rupture the disk.

11. The method of claim 1, further comprising reducing a fluid pressure within the pipe upon rupturing the disk of the pipe.

12. The method of claim 1, further comprising circulating fluid through the pipe and the plug following rupture of the disk.

13. The method of claim 1, further comprising:

retrieving the pipe from the wellbore;

repairing the pipe; and redeploying the pipe to the wellbore.

14. The method of claim 1, further comprising locating the pipe at a first axial position along the wellbore prior to flowing the plug downhole through the pipe.

15. The method of claim 14, further comprising locating the pipe at a second axial position along the wellbore after rupturing the disk of the plug, the second axial position being downhole relative to the first axial position.

16. The method of claim 15, wherein the plug is a first plug, the disk is a first disk, the channel is a first channel, and the fluid pressure is a first fluid pressure, the method further comprising:

flowing a second plug downhole within fluid through the pipe;

landing the second plug on the first plug;

flowing fluid downhole through the pipe against the second plug positioned on the first plug; and rupturing a second disk of the second plug with a second pressure of the fluid to open the pipe to fluid flow through a second channel of the second plug and through the first channel of the first plug.

17. A method of performing a completion operation at a wellbore, the method comprising:

locating a pipe disposed within the wellbore at a first axial position along the wellbore;

after locating the pipe at the first axial position, flowing a plug downhole within fluid through the pipe;

landing the plug on a platform carried on the pipe to close the pipe to fluid flow;

flowing fluid downhole through the pipe against the plug positioned on the platform;

rupturing a disk of the plug with a pressure of the fluid to open the pipe to fluid flow through a channel of the plug; and after rupturing the disk of the plug, locating the pipe at a second axial position along the wellbore, the second axial position being downhole relative to the first axial position.

* * * * *